United States Patent [19]

Harashima et al.

[11] Patent Number: 4,700,676

[45] Date of Patent: Oct. 20, 1987

[54] INTAKE CONTROL DEVICE

[75] Inventors: Tadashi Harashima; Hideo Morita, both of Yokohama; Eiji Mori, Kamakura, all of Japan

[73] Assignee: Nissan Motor Co., Ltd., Yokohama, Japan

[21] Appl. No.: 814,991

[22] Filed: Dec. 31, 1985

[30] Foreign Application Priority Data

Jan. 7, 1985 [JP] Japan ..... 60-153

[51] Int. Cl.[4] ..... F02M 3/12

[52] U.S. Cl. ..... 123/339; 123/442; 123/585

[58] Field of Search ..... 123/308, 339, 432, 442, 123/585, 586, 587

[56] References Cited

U.S. PATENT DOCUMENTS

| | | | |
|---|---|---|---|
| 4,313,410 | 2/1982 | Kunii et al. | 123/585 X |
| 4,378,766 | 4/1983 | Yamazoe et al. | 123/339 |
| 4,475,505 | 10/1984 | Hasegawa et al. | 123/585 X |
| 4,506,640 | 3/1985 | Abe | 123/585 X |
| 4,513,700 | 4/1985 | Hayashida | 123/442 X |
| 4,532,902 | 8/1985 | Mizuno et al. | 123/308 X |
| 4,562,808 | 1/1986 | Tominaga et al. | 123/339 |

FOREIGN PATENT DOCUMENTS

| | | | |
|---|---|---|---|
| 54-42525 | 4/1979 | Japan . | |
| 150516 | 11/1979 | Japan . | |
| 58-23262 | 2/1983 | Japan . | |
| 0195018 | 11/1983 | Japan | 123/308 |

*Primary Examiner*—Willis R. Wolfe, Jr.

*Attorney, Agent, or Firm*—Schwartz, Jeffery, Schwaab, Mack, Blumenthal & Evans

[57] ABSTRACT

An intake control device including a main intake passage provided with a throttle valve and a shut off valve disposed downstream of the throttle valve, and a bypass passage branched off from an upstream portion of the throttle valve and joined to the main intake passage at a portion downstream of the shut off valve. The amount of air through the bypass passage is controlled by an idle control valve. Owing to this arrangement, the residual gas within the downstream portion of the shut off valve is effectively removed by sufficient amount of scavenging air supplied by the bypass passage.

4 Claims, 4 Drawing Figures

INTAKE CONTROL DEVICE

BACKGROUND OF THE INVENTION

The present invention relates to an intake control device for an internal combustion engine of the type having an auxiliary intake passage.

Laying-open Japanese patent application No. 54-150516 discloses an intake control device for an internal combustion engine. The intake control device comprises an auxiliary intake passage branched off from a main intake passage at a portion upstream of a shut off valve disposed downstream of a throttle valve, and joined to the main intake passage at a portion downstream of the shut off valve. This auxiliary intake passage is so designed as to admit intake air into a combustion chamber in such a direction as to cause generation of swirl within the combustion chamber. When, in operation, the engine idles, the throttle valve is closed and shut off valve is closed, too. Under this condition, intake air flows past a clearance formed around the throttle valve, then through the auxiliary intake passage bypassing the shut off valve and then into the combustion chamber.

An object of the present invention is to provide an intake control device for an internal combustion engine which provides a sufficient amount of scavenging air at engine low load operation including idle operation.

SUMMARY OF THE INVENTION

According to the present invention, an intake control device for an internal combustion engine, comprises:

a main intake passage for admitting intake air to the internal combustion engine;

a throttle valve disposed in the main intake passage;

a shut off valve disposed in the main intake passage at a location downstream of the throttle valve;

an auxiliary passage branched off from the intake passage at a location downstream of the throttle valve and upstream of the shut off valve, and joined to the main intake passage at a location downstream of the shut off valve;

a bypass passage branched off from the main intake passage at a location upstream of the throttle valve and joined to the main intake passage at a location downstream of the shut off valve; and an idle control valve provided to adjust the amount of air passing through the bypass passage.

DESCRIPTION OF THE EMBODIMENTS

Figure 1:
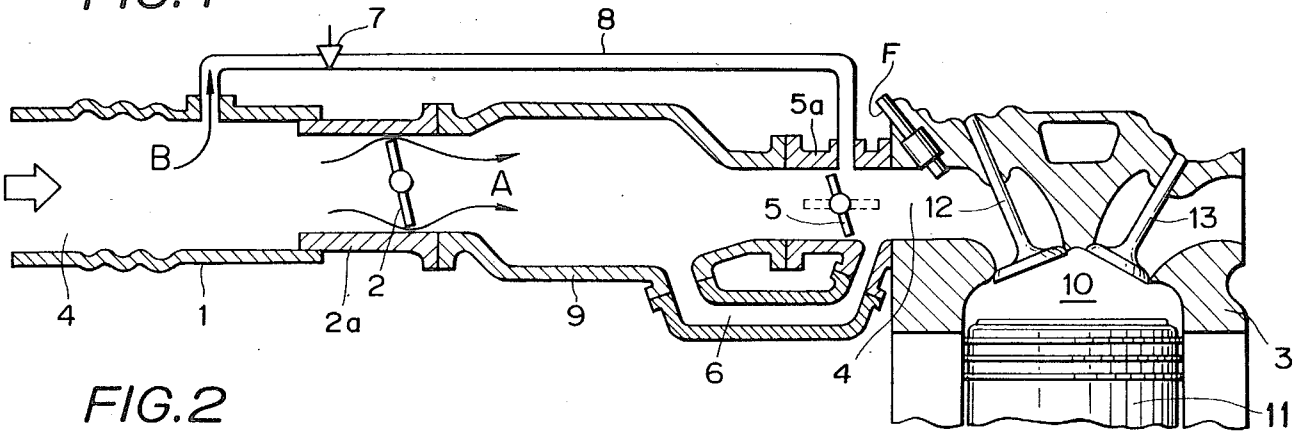
FIG. 1 is a schematic sectional diagram of a first embodiment of an intake control device according to the present invention.
Figure 3:
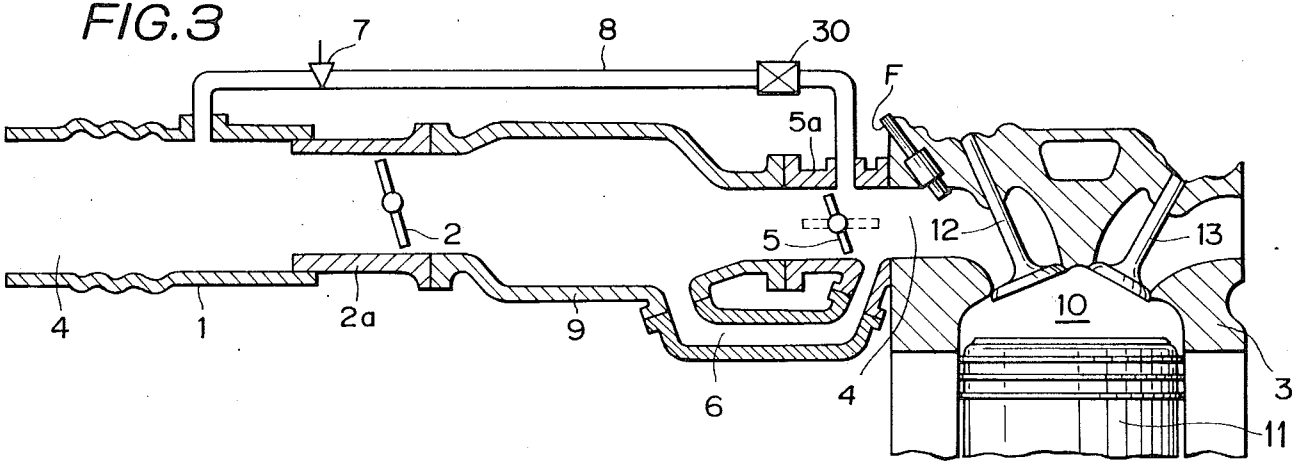
FIG. 3 is a similar diagram of a third embodiment.

Referring to FIG. 1, a first embodiment of an intake control device for an internal combustion engine is described. In FIG. 1, the reference character F designates a fuel injector and the reference numeral 1 an intake pipe. A throttle valve 2 is disposed in a throttle barrel 2*a* connected to the intake pipe 1. An intake manifold 9 is connected to the throttle barrel 2*a*. A shut off valve 5 is disposed in a valve body 5*a* that is connected between one of branches of the intake manifold 9 and a cylinder head 3 of an internal combustion engine in such a manner as to provide communication between the branch of the intake manifold 9 and an intake port passage 4 that is formed through the cylinder head 3 and communicable with a combustion chamber 10 under the control of an intake valve 12. The internal combustion engine is also provided with a piston 11 that defines the combustion chamber 10 and an exhaust valve 13. The intake pipe 1, throttle barrel 2*a*, intake manifold 9, and cylinder head 3 cooperate with each other to define a main intake air passage 4 for admitting intake air into the combustion chamber 10. An auxiliary passage 6 is branched off from the main intake passage 4 at a portion downstream of the throttle valve 2 and upstream of the shut off valve 5 and joined to the main intake passage 4 at a portion downstream of the shut off valve 5. A bypass passage 8 is branched off from the main intake passage 4 at a portion upstream of the throttle valve 2 and joined to the main intake passage 4 at a portion downstream of the shut off valve 5. The bypass passage 8 is provided with an idle control valve 7. Preferably, as shown in FIG. 3, an air filter 30 is disposed in the fresh air passage 8 downstream of the idle control valve 7 so as to prevent entry of dust particles together with air passing through the fresh air passage 8.

The throttle valve 2 is operatively associated with an accelerator of an automobile, not shown. The shut off valve 5 is opened or closed by a vacuum actuator (not shown) operable on manifold vacuum created within the intake manifold 9 such that, when the throttle valve 2 is closed at low load engine operation including engine idling, the vacuum actuator fully closes the shut off valve 5 because the intake manifold vacuum increases, whereas, when the intake manifold vacuum decreases during engine operation with full load, the shut off valve 5 is urged to move to its full open position as illustrated by the broken line.

The idle control valve 7 is designed to be operable to adjust the flow rate of air passing through the bypass passage 8 during engine operation with light load including an engine idling. The idle control valve 7 is operable, via a solenoid operated actuator, in response to engine temperature as detected for example by a bimetal.

When, in operation, the engine operates with low load, such as when the engine idles, the throttle valve 2 takes the illustrated position wherein the throttle valve 2 cooperates with the adjacent intake pipe wall a clearance around its periphery through which a small amount of air passes, and since the manifold vacuum increases, the vacuum actuator that operates on the intake manifold vacuum urges the shut off valve 5 to assume fully closed position as illustrated by fully drawn line. Under this condition, the flow of intake air sucked into the intake pipe 1 is divided into two, one passing through the clearance around the periphery of the throttle valve 2 and enters the intake manifold 9 as indicated by arrows A, whereas the other entering the bypass passage 8 as indicated by an arrow B. Air entering the intake manifold 9 flows through the auxiliary passage 6 into the main intake passage 4 downstream of the shut off valve 5.

On the other hand, air entering the bypass passage 8 flows into the main intake passage 4 downstream of the shut off valve 5. The amount of air passing through the bypass passage 8 is appropriately adjusted during engine operation with light load including engine idling by the idle control valve 7. Residual gas is effectively removed by sufficient amount of scavenging air supplied from the bypass passage 8. The residual gas is blown out of the combustion chamber 10 into the portion downstream of the shut off valve 5 during the overlap of the intake valve 12 with the exhaust valve 13 which takes place during the ascending stroke of the piston 11.

Figure 2:
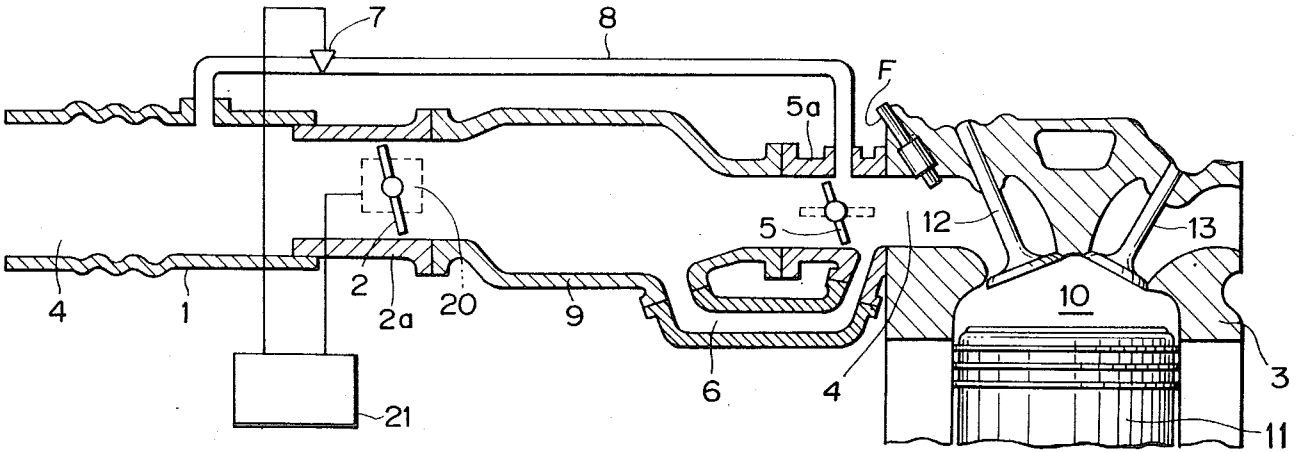
FIG. 2 is a similar diagram of a second embodiment.

Referring to FIG. 2, a second embodiment is described. This embodiment is substantially the same as the first embodiment except the provision of a throttle opening degree detector 20, including an idle switch, and a control unit 21 that receives an output signal of the detector 20 which is indicative of the opening degree of a throttle valve 2. The control unit 21 determines the opening degree of an idle control valve 7 is accordance with a predetermined schedule in connection with the opening degree of the throttle valve 2. The output signal of the control unit 21 which is indicative of the opening degree of the idle control valve 7 is supplied to the idle control valve 7. In this manner, the idle control valve 7 is controlled in close relationship with the opening degree of the throttle valve 2.

Figure 4:
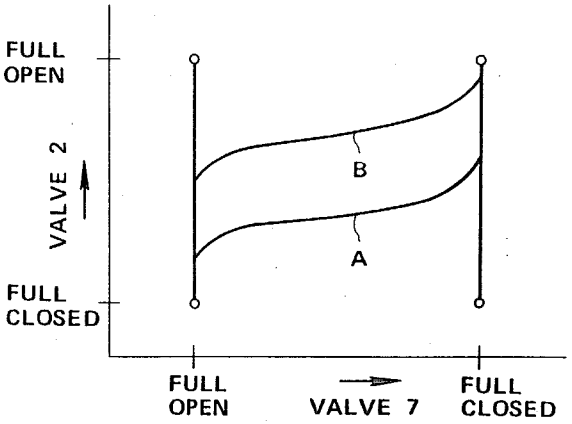
FIG. 4 is a diagram illustrating the relationship of the opening degree of an idle control valve with that at a throttle valve.

One example of a control strategy of the idle control valve 7 is shown in FIG. 4. The idle control valve 7 is fully closed when the idle switch is ON or the vehicle speed is less than 8 km/hr, but fully opened when the vehicle speed is greater than 8 km/hr During rapid acceleration, the throttle opening degree of the idle control valve 7 is increased versus that of the throttle valve 2 in a schedule as shown by a curve A, while it is increased in another schedule as shown by a curve B.

Referring to FIG. 3, a third embodiment is described, which is a more pratical embodiment than the first and second embodiments. This third embodiment is different from the first embodiment shown in FIG. 1 in the provision of an air filter 30 disposed in a bypass passage 8 downstream of an idle control valve 7. This is effective in preventing entry of dust particles together with scavenging air passing through the passage 8 into a main intake passage downstream of a shut off valve 5.

What is claimed is:

1. A control device for an internal combustion engine, comprising:

a main intake passage admitting intake air to the internal combustion engine;

a throttle valve disposed in said main intake passage;

a shut off valve disposed in said main intake passage as a location downstream of said throttle valve;

an auxiliary passage having an inlet end opening to said main intake passage at a location downstream of said throttle valve and upstream of said shut off valve, and an outlet end opening to said main intake passage at a location downstream of said shut off valve;

means for controlling idle comprising a bypass passage and an idle control valve, said bypass passage having an inlet end opening to said main intake passage at a location upstream of said throttle valve and an outlet end opening to the main intake passage at a location downstream of said shut off valve, said idle control valve disposed in said bypass passage to adjust the amount of air passing through said bypass passage.

2. The intake control device as claimed in claim 1, wherein said idle control valve is controlled in close relationship with said throttle valve.

3. The intake control device as claimed in claim 1 wherein said bypass passage includes an air filter arranged in said bypass passage downstream of said idle control valve.

4. The intake control device as claimed in claim 1, wherein said idle control means includes means for delivering air from said bypass inlet end opening to said bypass outlet end opening in an uncompressed state.

* * * * *